US008033499B2

(12) United States Patent
Yang

(10) Patent No.: US 8,033,499 B2
(45) Date of Patent: Oct. 11, 2011

(54) BIOMIMETIC MICRO-AERIAL-VEHICLE WITH FIGURE-EIGHT FLAPPING TRAJECTORY

(75) Inventor: Lung-Jieh Yang, Tamsui (TW)

(73) Assignee: Tamkang University, Tamsui (TW)

( * ) Notice: Subject to any disclaimer, the term of this patent is extended or adjusted under 35 U.S.C. 154(b) by 457 days.

(21) Appl. No.: 12/313,545

(22) Filed: Nov. 24, 2008

(65) Prior Publication Data

US 2009/0179108 A1 Jul. 16, 2009

(30) Foreign Application Priority Data

Jan. 15, 2008 (TW) ..... 97101553 A

(51) Int. Cl.
*B64C 33/00* (2006.01)

(52) U.S. Cl. ..... 244/22; 244/72

(58) Field of Classification Search ..... 244/11, 244/12.1, 22, 28

See application file for complete search history.

(56) References Cited

U.S. PATENT DOCUMENTS

| | | | | |
|---|---|---|---|---|
| 5,163,861 | A * | 11/1992 | Van Ruymbeke | 446/35 |
| 5,170,965 | A * | 12/1992 | Yasuda | 244/64 |
| 6,824,094 | B2 * | 11/2004 | Richard | 244/11 |
| 6,840,476 | B1 * | 1/2005 | Raney | 244/11 |
| 7,036,769 | B2 * | 5/2006 | Wood | 244/11 |
| 7,651,051 | B2 * | 1/2010 | Agrawal et al. | 244/22 |
| 2003/0094538 | A1 * | 5/2003 | Woo et al. | 244/11 |

* cited by examiner

*Primary Examiner* — Joshua Michener
*Assistant Examiner* — Keith L Dixon

(57) ABSTRACT

A micro aerial vehicle includes: a fuselage; a flapping transmission mechanism mounted on a front portion of the fuselage; a flexible wing frame secured to and driven by the flapping transmission mechanism for producing a figure-eight flapping trajectory for mimicking the flight of a tiny natural flier, such as hummingbird; and a tail wing secured to a tail portion of the fuselage; wherein the flexible wing frame is formed by respectively pivotally or rotatably mounting a wing skin made of parylene foil to a pair of leading-edge arm members made of carbon fiber, and linked to the flapping transmission mechanism to thereby make a miniaturized micro aerial vehicle.

9 Claims, 3 Drawing Sheets

Fig. 6
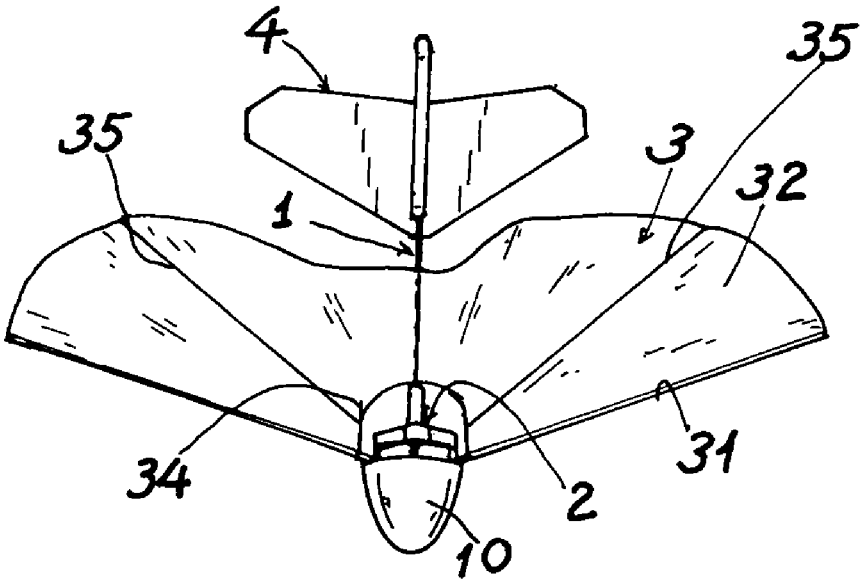
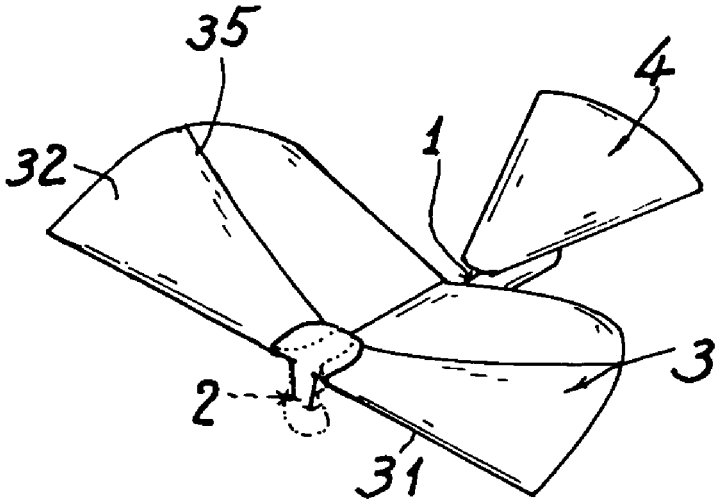
Fig. 7

BIOMIMETIC MICRO-AERIAL-VEHICLE WITH FIGURE-EIGHT FLAPPING TRAJECTORY

BACKGROUND OF THE INVENTION

U.S. Pat. No. 6,227,483 disclosed a wing movement for ornithopters including a plurality of pairs of wings mounted to the output shafts and each movable along a curved infinity-symbol-like pattern projecting substantially along one side of the drive motor.

However, this prior art has the following drawbacks:

1. Two motors and two gear boxes are required for driving the pairs of wings to increase the total weight of the ornithopter, thereby limiting the miniaturization of an ornithopter or micro-aerial-vehicle (MAV).
2. A pair of wing movements (72, 74) are provided each having a pair of wings (76, 78; 80, 82), so that total four wings are required for constructing such an ornithopter, thereby possibly increasing product weight, installation complexity and maintenance problems.

The present inventor has found the drawbacks of the prior art and invented the present micro aerial vehicle with lighter and simpler construction.

SUMMARY OF THE INVENTION

The object of the present invention is to provide a micro aerial vehicle including: a fuselage; a flapping transmission mechanism mounted on a front portion of the fuselage; a flexible wing frame secured to and driven by the flapping transmission mechanism for producing a figure-eight flapping trajectory for mimicking the flight of a tiny natural flier, such as hummingbird; and a tail wing secured to a tail portion of the fuselage; wherein the flexible wing frame is formed by respectively pivotally or rotatably mounting a wing skin made of parylene foil to a pair of leading-edge arm members made of carbon fiber, and linked to the flapping transmission mechanism so as to produce a miniaturized micro aerial vehicle.

BRIEF DESCRIPTION OF THE DRAWINGS

FIG. 6 shows the present invention having a wavy wing and a nose cone.

FIG. 7 shows the present invention having a modified tail wing.

DETAILED DESCRIPTION

As shown in FIGS. 1-5, the micro aerial vehicle (or micro air vehicle, MAV) of the present invention comprises: a fuselage 1, a flapping transmission mechanism 2 mounted on a front portion of the fuselage 1, a flexible wing frame 3 pivotally secured to the flapping transmission mechanism 2, and a tail wing 4 mounted on a tail portion of the fuselage 1.

The fuselage 1 may simply be a longitudinal beam or rod made of light material, such as carbon fiber, aluminum or titanium alloy, or a light plastic material, not limited in the present invention.

The flapping transmission mechanism (or flapping means) 2 may be formed as one degree-of-freedom (DOF) flapping movement, and is mounted on the front portion of the fuselage 1 and positioned under the flexible wing frame 3 for driving the flexible wing frame 3 for producing a figure-eight trajectory at a wing tip of the flexible wing frame 3 for rendering the thrust and lift of the micro aerial vehicle of the present invention.

Figure 1:
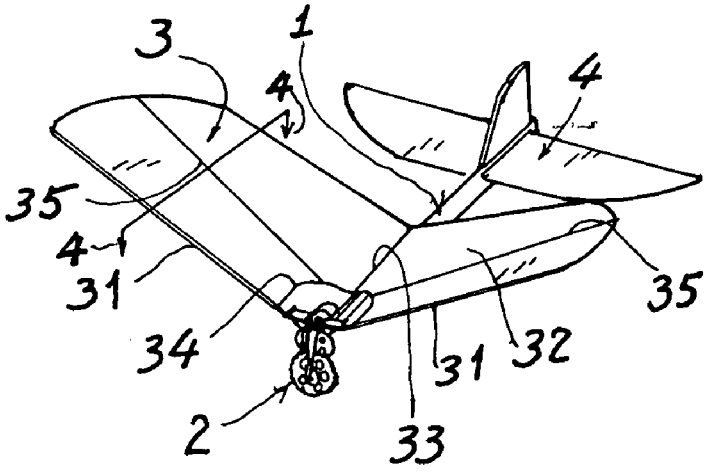
FIG. 1 is a perspective view of the present invention.
Figure 2:
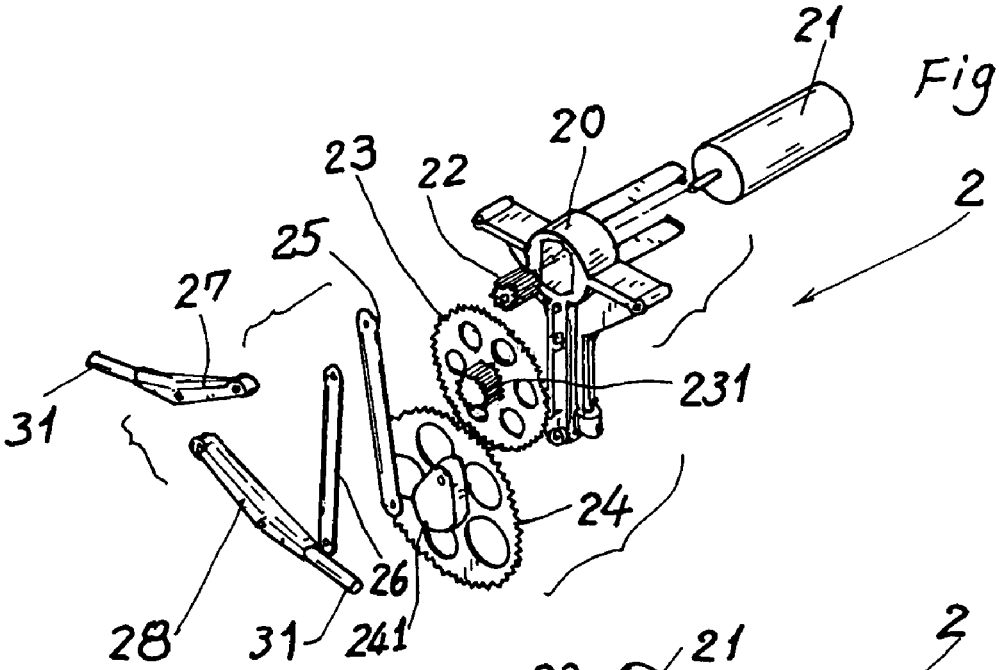
FIG. 2 shows a flapping transmission mechanism as exploded in accordance with the present invention.
Figure 3:
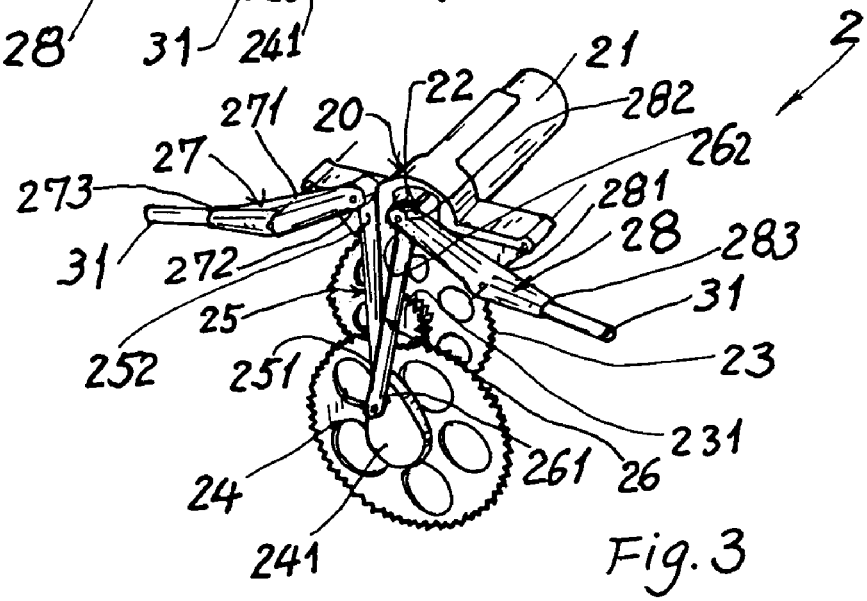
FIG. 3 shows an assembled flapping transmission mechanism of the present invention.

As shown in FIGS. 2 and 3, the flapping transmission mechanism 2 is a four-bar linkage transmission system made of light materials, and includes: a base 20 secured to a front portion of the fuselage 1; a motor 21 electrically connected to a battery (not shown) secured on the fuselage 1; a driving gear 22 coaxially connected to the motor 21; a speed-reducing gear set composed of an inner gear 23 operatively driven by the driving gear 22 and an outer gear 24 engaged with and driven by the inner gear 23 through a pinion 231 coaxially secured to the inner gear 23 for reducing a revolution speed of the motor; a cam 241 coaxially connected with the outer gear 24; a pair of driving links 25, 26 having their lower link ends 251, 261 respectively pivotally connected to the cam 241; a pair of biasing links 27, 28 having their central link portions 271, 281 pivotally secured to opposite end portions of the base 20 and having the inner link portions 272, 282 of the biasing links 27, 28 respectively pivotally connected with the upper ends 252, 262 of the driving links 25, 26 and having the outer link portions 273, 283 of the biasing links 27, 28 respectively pivotally connected to a pair of leading-edge arm members 31, 31 of the flexible wing frame 3; whereby upon starting of the motor 21, the pair of leading-edge arm members 31, 31 of the flexible wing frame 3 will be vertically reciprocatively flapped by the four-bar linkage transmission system of the flapping transmission mechanism 2.

Figure 4:
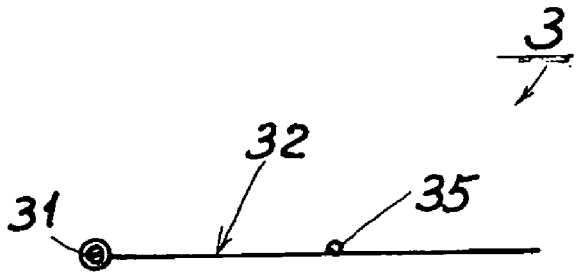
FIG. 4 is a cross-sectional drawing as viewed from Line 4-4 of FIG. 1.
Figure 5:
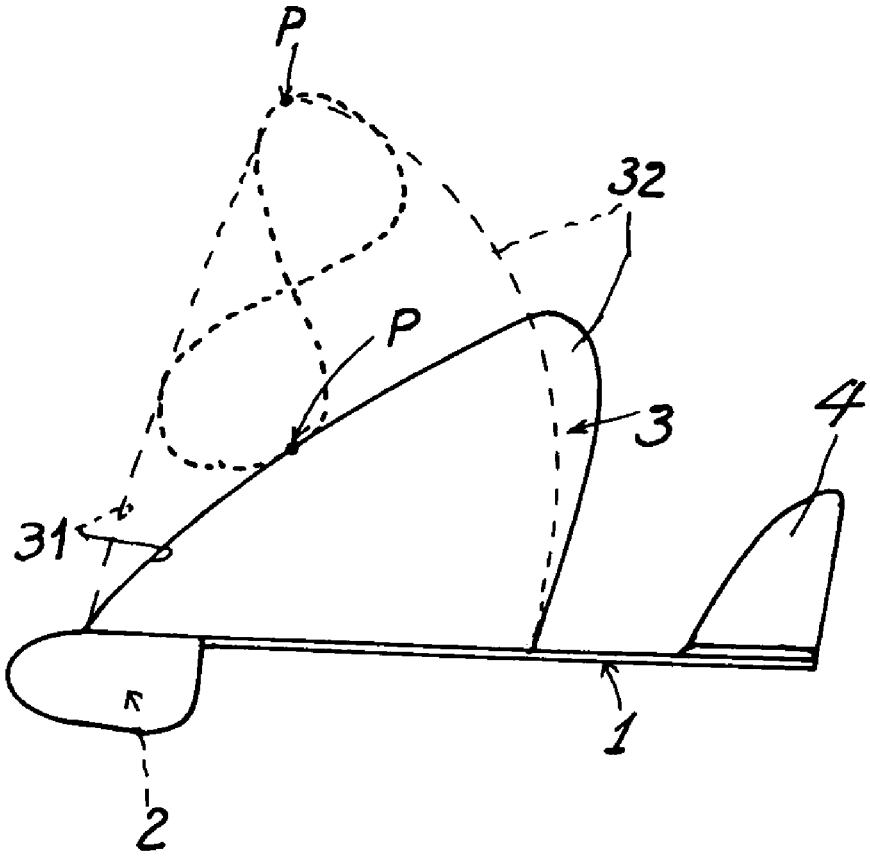
FIG. 5 is a side-view illustration showing a figure-eight trajectory of a wing tip of a flapping right wing portion in accordance with the present invention.

The flexible wing frame 3 includes: a pair of leading-edge arm members 31 respectively connected to and driven by the flapping transmission mechanism 2, a wing skin (composed of a right and a left wing portion) 32 pivotally secured to the pair of leading edge arm members 31 (especially as shown in FIG. 4) and protruding rearwardly or sidewardly from a leading edge of the wing frame 3 towards a trailing edge of the wing frame, and at least a pair of ribs 35 each integrally formed on the wing skin 32 and juxtapositioned to each leading-edge arm member 31. Each arm member 31 is preferably formed as a round bar or rod (FIG. 4). Each rib 35 may define an acute angle (such as 30 degrees) between each rib 35 and its juxtapositioned arm member 31, but the angle being not limited.

A front opening 34 is formed in a front portion of the central or root portion 33 of the flexible wing frame 3, allowing the up-and-down reciprocative movements of the flapping transmission mechanism 2 and preventing from "deadlocking" of the wing skin 32 when performing the figure-eight flapping operation.

The leading-edge arm member 31 may be made of carbon fiber or light-weight plastic or metallic materials, such as aluminum or titanium alloy.

The wing skin 32 may be made of parylene (or poly-para-xylylene) foil or other flexible thin films.

Upon reciprocative movement of the four-bar linkage flapping transmission mechanism 2 of the present invention, the pair of leading-edge arm members 31 of the wing frame 3 will be vertically reciprocatively flapped in repeated up-and-down motions for flapping the wing skin 32 as pivotally secured to the leading-edge arm members 31.

Accordingly, the micro aerial vehicle of the present invention will perform the flapping movements as following analysis:

1. The leading-edge arm members 31 are vertically reciprocatively flapped with a first frequency (or a flapping frequency, such as: 15.6~21.7 Hz). Coherently, the wing skin 32 is reciprocatively vibrated streamwise to develop a second frequency (or a vibrating frequency) at each wing tip, which is twofold of the first frequency.
2. Each rib 35, as integrally formed with the wing skin 32, will play an important role like a shaft connected with vane barbs of a bird feather for cambering air for enhancing the lift during the flapping strokes.
3. Since the parylene foil of wing skin 32 is pivotally or rotatably secured to the leading-edge arm members 31 (FIG. 4), the instantaneous angle-of-attack of the wing will be simultaneously varied corresponding to the harmonic and sinusoidal flapping motions of the wing frame to thereby produce enough lift and thrust due to the unsteady flow mechanism of delayed stall, wake capture and rotation circulation.

The wingbeat frequency may range, for instance, from 15.6 to 21.7 Hz, which is smaller than the natural frequency (e.g., 85 Hz) of the wing structure of the present invention, to thereby prevent the occurrence of resonance of the wing frame and prevent damage of the wing frame of this invention.

The wing skin of the present invention is preferably formed as wavy shape as shown in FIG. 6 for smoothly transferring the vibrational waves (or sinuous waves) streamwise from the leading edge towards the trailing edge and from the wing tips towards the central wing root portion for enhancing the figure-eight flapping motions of the present invention.

A nose cone 10 may be further formed on a front end portion of the fuselage 1 to reduce wind resistance during the flying of the present invention (FIG. 6).

The tail wing 4 may also be modified as shown in FIG. 7, or may be further modified for improving the performance of the vehicle.

The present invention provides a micro aerial vehicle capable for exerting figure-eight ("8") flapping pattern for fantastically mimicking a natural hummingbird. The 8-shaped flapping pattern of the present invention is reciprocatively oriented vertically, rather than a horizontal figure-eight pattern, to thereby enhance both lift and thrust synergetically.

Even the excellent flying performance of the present invention may be presented, the weight and size of the vehicle has, however, been greatly minimized as palm size even as low (light) as 5.9 grams for a wingspan of 21.6 cm. Therefore, a miniaturization of a micro aerial vehicle may be accomplished, without deteriorating its flying performance, in accordance with the present invention.

The present invention may be further modified without departing from the spirit and scope of the present invention.

I claim:

1. A micro aerial vehicle comprising:

a fuselage;

a flapping transmission mechanism mounted on said fuselage;

a flexible wing frame including a pair of leading-edge arm members respectively secured to said flapping transmission mechanism, and a wing skin having a right wing portion and a left wing portion respectively pivotally secured to said pair of leading-edge arm members; and a tail wing secured to a tail portion of said fuselage; whereby upon operation of said flapping transmission mechanism to vertically reciprocatively flap said leading-edge arm members with a first frequency and to coherently reciprocatively vibrate said wing skin streamwise to develop a second frequency, which is twofold of said first frequency, at each wing tip of said wing skin, a figure-eight trajectory will form at each said wing tip of said wing skin.

2. A micro aerial vehicle according to claim 1, wherein said flapping transmission mechanism is a four-bar linkage transmission system.

3. A micro aerial vehicle according to claim 2, wherein said flapping transmission mechanism, as pivotally connected with said pair of leading-edge arm members, includes: a base mounted to said fuselage; a motor mounted on said base; a speed-reducing gear set rotatably secured to said base and operatively driven by said motor; a pair of driving links respectively pivotally linked to said gear set and operatively driven by said gear set; and a pair of biasing links respectively pivotally mounted on said base and each said biasing link inwardly pivotally linked to each said driving link to be vertically reciprocated by said driving link; each said biasing link outwardly connected with each said leading-edge arm member for operatively reciprocatively flapping each said leading-edge arm member.

4. A micro aerial vehicle according to claim 1, wherein each said leading-edge arm member is made of carbon fiber.

5. A micro aerial vehicle according to claim 1, wherein said wing skin is made of parylene or poly-para-xylylene.

6. A micro aerial vehicle according to claim 1, wherein said wing skin includes a plurality of ribs integrally formed with said wing skin.

7. A micro aerial vehicle according to claim 1, wherein said wing skin includes at least a pair of ribs, each said rib juxtapositioned to each said leading-edge arm member and having an acute angle defined between each said rib and each said arm member juxtapositioned to said rib.

8. A micro aerial vehicle according to claim 1, wherein said wing skin is formed as wavy shape adapted for smoothly transferring a vibrational wave on said wing frame.

9. A micro aerial vehicle according to claim 1, wherein said wing skin includes a front opening formed in a front portion of said wing frame and said fuselage for allowing a reciprocative flapping motion of said wing frame.

* * * * *